US005249535A

United States Patent [19]

Chung

[11] Patent Number: 5,249,535

[45] Date of Patent: Oct. 5, 1993

[54] LOW $NO_x$ BURNER

[76] Inventor: Landy Chung, 5144 Cliff Dr., Ashtabula, Ohio 44004

[21] Appl. No.: 995,942

[22] Filed: Dec. 21, 1992

Related U.S. Application Data

[63] Continuation of Ser. No. 856,234, Mar. 25, 1992, abandoned.

[51] Int. Cl.[5] ..... F23D 1/02

[52] U.S. Cl. ..... 110/264; 110/347; 239/502; 431/183

[58] Field of Search ..... 110/263, 264, 347; 431/182, 183, 184; 239/500, 501, 502

[56] References Cited

U.S. PATENT DOCUMENTS

| | | | |
|---|---|---|---|
| 1,527,214 | 2/1925 | Peabody . | |
| 1,628,424 | 5/1927 | Peabody . | |
| 1,870,013 | 4/1932 | Keenan, Jr. . | |
| 1,995,934 | 3/1935 | Mangold . | |
| 2,320,576 | 6/1943 | Dunn . | |
| 2,480,547 | 8/1949 | Caracristi . | |
| 2,525,432 | 10/1950 | Stadler . | |
| 2,815,069 | 12/1957 | Garraway . | |
| 2,838,103 | 6/1958 | Voorheis . | |
| 2,889,871 | 6/1959 | Voorheis . | |
| 3,145,670 | 8/1964 | Copian et al. . | |
| 3,411,716 | 11/1968 | Stephan et al. . | |
| 3,743,471 | 7/1973 | Jaeger . | |
| 3,944,142 | 3/1976 | Welden et al. . | |
| 4,050,632 | 9/1977 | Wyse . | |
| 4,087,050 | 5/1978 | Tsuji et al. . | |
| 4,223,615 | 9/1980 | Breen et al. | 110/264 |
| 4,253,403 | 3/1981 | Vatsky . | |
| 4,348,170 | 9/1982 | Vatsky et al. . | |
| 4,400,151 | 8/1983 | Vatsky . | |
| 4,457,241 | 7/1984 | Itse et al. | 110/347 |
| 4,504,216 | 3/1985 | Hagar et al. . | |
| 4,681,532 | 7/1987 | Chung . | |
| 4,927,352 | 5/1990 | Chung . | |
| 5,113,771 | 5/1992 | Rini et al. | 110/263 |

FOREIGN PATENT DOCUMENTS

| | | |
|---|---|---|
| 233901 | of 1960 | Australia . |
| 339844 | 8/1921 | Fed. Rep. of Germany . |
| 958907 | 5/1964 | United Kingdom . |

OTHER PUBLICATIONS

"Large Burners and Low $No_x$", Foster Wheeler Energy Corporation brochure, Published 1979.

"Current Developments In Low $No_x$ Firing Systems", Published by Combustion Engineering, Inc., Oct. 1980.

*Primary Examiner*—Edward G. Favors

*Attorney, Agent, or Firm*—Watts, Hoffmann, Fisher & Heinke Co.

[57] ABSTRACT

A low-nox burner for use in industrial furnaces and/or boilers which burn pulverized coal. The burner includes a burner tip which divides an annular pulverized coal stream into alternating fuel-rich and fuel-lean streams. The tip includes a plurality of alternating main and secondary blade members which are skewed to produce rotational movement in the streams. The main blade has a leading edge that is aligned with a radial vector extending through a center axis of the burner and a trailing edge that is tilted with respect to the radial vector in order to define a substantially planar surface between the leading and trailing edges. The secondary blade includes leading and trailing edges that are both aligned with radial vectors and defines a twisted surfaces between the edges. The secondary blade is skewed with respect to the longitudinal direction by an angle that is substantially greater than the angle at which the main blade is skewed. As a result, channels having converging cross sections are defined between the main blade and one adjacent secondary blade, and diverging channels are defined by the main blade and another adjacent secondary blade. During operation, the tip creates a fuel-rich zone surrounded by a fuel-lean zone in the combustion region.

26 Claims, 3 Drawing Sheets

LOW $NO_x$ BURNER

This application is a continuation of application Ser. No. 07/856,234 filed Mar. 25, 1992 now abandoned.

TECHNICAL FIELD

The present invention relates generally to industrial furnaces and/or boilers which burn pulverized coal, and more specifically, to an improved coal burner which reduces the formation of nitrogen oxides during the combustion process.

BACKGROUND

Recently, considerable attention and efforts have been directed to the reduction of nitrogen oxides resulting from the combustion of fuel. This is especially true in the area of large furnaces or boilers such as used by the power generation utilities which utilize coal as their main fuel source. In a typical arrangement for burning coal in a large boiler, several burners are disposed in communication with the interior of the boiler and operate to burn a mixture of air and pulverized coal. The burners used in these arrangements are generally of the type in which a fuel-air mixture is continuously injected through a nozzle so as to form a single, relatively large flame. As a result, the surface area of the flame is relatively small in comparison to its volume, and therefore, the average flame temperature is relatively high. However, in the burning of coal, nitrogen oxides are formed due to the reaction of nitrogen present in the combustion-supporting air with oxygen. The formation of nitrous oxides is a function of flame temperature. When the flame temperature exceeds 2800° F., the amount of nitrogen removed from the combustion-supporting air rises exponentially with increases in the temperature. This condition leads to the production of high levels of nitrogen oxides in the final combustion products, which is undesirable.

Nitrogen oxides are also formed from the fuel bound nitrogen available in the fuel itself, which is not a direct function of the flame temperature, but is related to the quantity of available oxygen during the combustion process.

DISCLOSURE OF THE INVENTION

It is, therefore, an object of the present invention to provide a burner assembly which operates in a manner to considerably reduce the production of nitrogen oxides in the combustion of fuel.

It is a more specific object of the present invention to provide an improved burner for use in a furnance which burns a pulverized coal-air mixture and which has an adjustable inner burner tip which provides proper fuel flow velocity at the burner outlet.

It is a still further object of the present invention to provide an improved burner nozzle of the above type in which the adjustable nozzle tip is designed to deliver the fuel in multiple streams and various patterns, more specifically, fuel-lean and fuel-rich zones to create stage-type combustion.

The present invention provides a new and improved coal burner which reduces formation of nitrogen oxides (hereinafter NOx) in a combustion zone of a large industrial boiler/furnace such as used by the utility industry. The disclosed burner can be retro-fitted to many existing boilers without major modifications.

The disclosed burner creates outer fuel-lean patterns which create a proper ignition point, stabilize the resulting flame, and control the formation of NOx. The improved burner further creates inner fuel-rich patterns which are somewhat confined or controlled by the outer fuel lean patterns. A stage-type combustion thereby occurs, creating the ability to control the peak flame temperature, the rate of combustion, and the formation of NOx.

When the fuel quality and conditions change, a burner tip can be adjusted to various positions to change the fuel-lean and fuel-rich flame pattern to maintain optimum NOx levels and combustion performance. In the illustrated embodiment, the burner tip can be manually adjusted from outside the combustion zone.

In its broader aspects then, a burner embodying the present invention for use with a pulverized coal furnace comprises an annular passage having an inlet for receiving a pulverized coal and air, and an outlet for discharging the mixture for ignition. A plurality of blade-like members are spaced radially at the outlet. The members are shaped and arranged to form the fuel-rich zones and fuel-lean zones as the mixture is discharged at the outlet.

In the preferred and illustrated embodiment, the plurality of blade-like members comprises a set of main blades and a set of secondary blades disposed in alternating relationship with the main blades. Both main and secondary blades are skewed at an angle with respect to the longitudinal axis of the burner to thereby impart a rotational moment to the fuel streams. In the disclosed embodiment, the main blades are planar in shape and are disposed at an angle that is less than the angle at which the secondary blades are skewed. In the illustrated embodiment, the main blades are skewed at an angle of substantially 15°.

The secondary blades are skewed at a greater angle which, in the illustrated embodiment, is substantially 25°. In addition, in the preferred embodiment, the secondary blades are twisted and have an uniformly varying surface extending between a leading edge and a trailing edge which is non-planar. With the disclosed construction, converging fuel-rich channels are defined between a main blade and one adjacent secondary blade and diverging, fuel-lean channels are formed with the main blade and its other adjacent secondary blade.

At least a portion of the burner that includes the burner tip is mounted for sliding movement towards and away from a combustion zone. Adjustments, which in the illustrated embodiment comprise control rods, extend outside the combustion zone and are capable of manipulation by the operator to adjust the position of the burner tip relative to the outlet to adjust combustion rate, flame pattern, etc.

The above and other features of the invention will be better understood from the detailed description that follows, when considered in connection with the accompanying drawings.

BEST MODE FOR CARRYING OUT THE INVENTION

Figure 1:
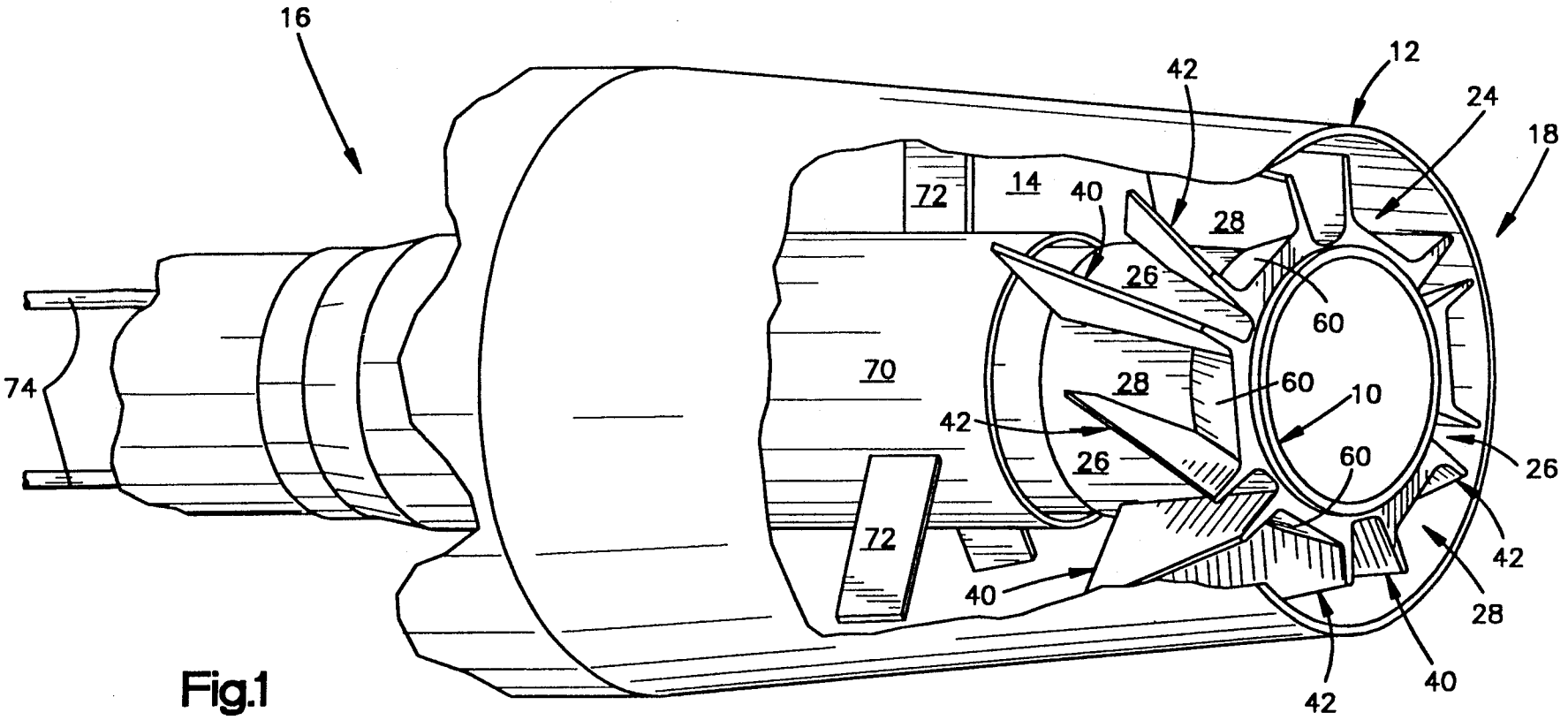
FIG. 1 is a perspective view of a burner constructed in accordance with a preferred embodiment of the invention with portions removed to show interior detail.

FIG. 1 illustrates the overall construction of a burner assembly constructed in accordance with the preferred embodiment of the invention and which is especially adapted for burning pulverized coal. The assembly includes a cylindrical core member 10, preferably centered with respect to an outer cylindrical housing member 12. An annular passage indicated generally by the reference character 14 is defined between the members 10, 12 and forms a flow path for a pulverized coal stream extending between an inlet indicated generally by the reference character 16 and an outlet 18. In operation, the outlet 18 opens into a combustion chamber forming part of the boiler. In large industrial boilers, a multiple number of burners may extend through a boiler wall (not shown) and extend into communication with the combustion chamber. As is known, as the pulverized coal stream exits the outlet 18, ignition occurs and the pulverized coal is burned in order to produce heat in the boiler.

In accordance with the invention, a stream dividing burner tip indicated generally by the reference character 24, is located near the outlet 18 and divides the pulverized coal stream into a plurality of alternating fuel-rich and fuel-lean fuel streams. In the preferred and illustrated embodiment, the burner tip 24 defines a plurality of channels 26, 28 positioned around the core member 10. During burner operation, the channels 26, 28 create the fuel rich and fuel lean streams, respectively. The channels 26, 28 are skewed with respect to the overall direction of flow in the annular passage 14 thereby imparting a rotational moment to the streams as they exit the nozzle.

Figure 3:
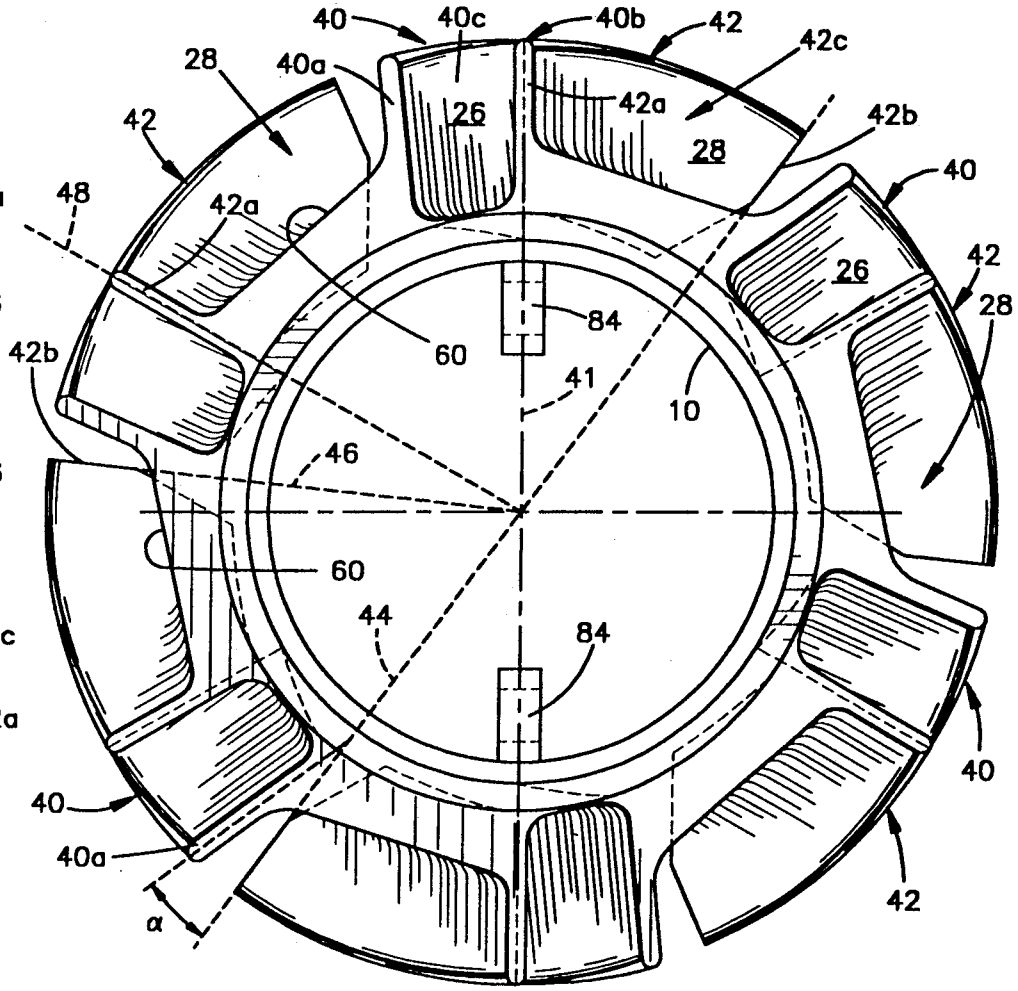
FIG. 3 is an end view of the nozzle shown in FIG. 3.
Figure 2:
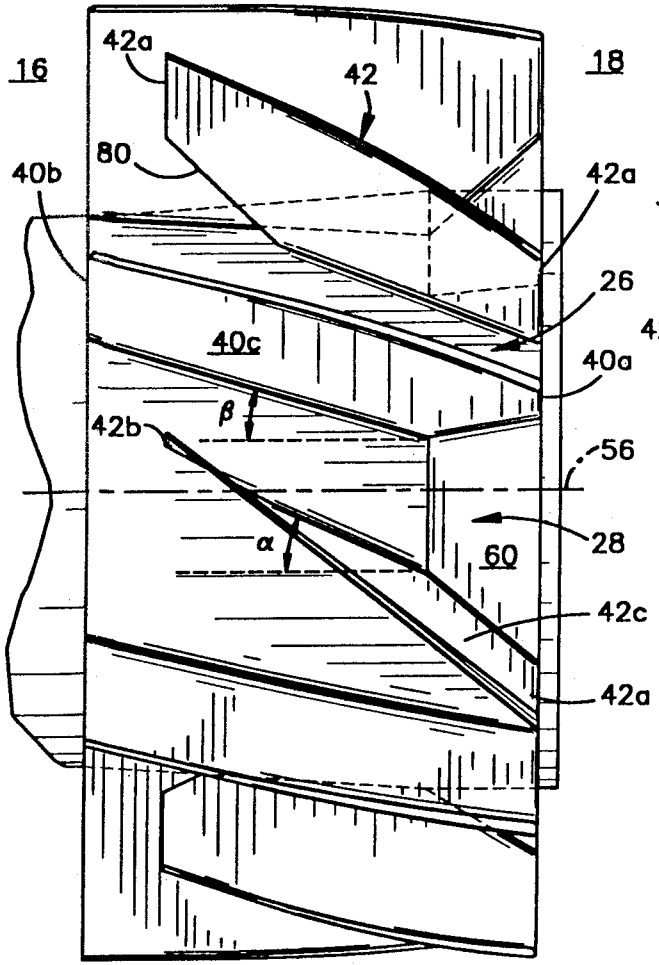
FIG. 2 is a fragmentary side view of a burner nozzle forming part of the burner shown in FIG. 1.

In the illustrated embodiment, the channels 26, 28 are defined by individual main and secondary blade members 40, 42 which extend radially outwardly from the core member 10. Referring also to FIGS. 2 and 3, the main blade 40, in the preferred embodiment, includes a leading edge **40*b* (the edge nearest the inlet 16 to the nozzle) aligned with a radial vector 41 extending through a center line 56 of the core member 10. A trailing edge 40*a* (the edge nearest the outlet 16) is tilted at a predetermined angle $\alpha$ with respect to a radial vector 44. The main blade is skewed at an angle $\beta$ with respect to an imaginary reference plane aligned with the longitudinal axis of the core member as viewed in plan (shown best in FIG. 2). In the illustrated embodiment, the angle $\alpha$ and the angle $\beta$ are 20° and 15°, respectively and as a result, a relatively planar section 40*c* extends between the leading and trailing edges 40*a*, 40*b* of the main blade 40**.

In the preferred embodiment, the secondary blade 42 is twisted as compared to the substantially planar main blade 40. In particular, the secondary blade 42 includes a leading edge **42*b* aligned with a radial vector 46 and a trailing edge 42*a* aligned with another radial vector 48. The overall secondary blade is skewed at an angle $\delta$ with respect to an imaginary reference plane aligned with the longitudinal axis 56 of the core member 10 as viewed in plan (shown best in FIG. 2). In the preferred embodiment, the angle $\delta$ is substantially 25°. As a result, a twisted or curved surface 42*c*, preferably uniformally varying extends between the leading and trailing edges 42*a*, 42*b* of the secondary blade 42**.

In order to define converging and diverging channel cross-sections, the blades 40, 42 are positioned at two different angles with respect to the overall directional flow along the annular passage. The primary blade 40 is positioned at a first angle $\beta$ which in the illustrated embodiment is approximately 15° whereas the secondary blade is positioned at a greater angle $\delta$, which in the illustrated embodiment is approximately 25°. As a result, the channel 26 has a converging cross-section as defined between the blade 40 and one of its adjacent blades 42 whereas the channel 28 has diverging cross-section as defined between the blade 40 and the other of its adjacent blades 42.

In the preferred and illustrated embodiment, the diverging cross-section channel 28 creates a fuel lean stream. As seen best in FIG. 1, ramp-like surfaces 60 are defined in the fuel lean channels 28 near the outlet. These ramp-like surfaces 60 urge the fuel lean streams outwardly with respect to the center line 56 of the core member 10 as the streams are discharged from the tip. As seen in FIG. 1, similar ramp-type surfaces are not defined by the fuel rich channels 26 and as a result, these streams although including a rotational component are not urged outwardly with respect to the center line 56. As a result, a fuel lean zone produced by the outwardly directed fuel lean streams surrounds a fuel rich combustion zone formed by the fuel rich streams, during operation of the burner. The combination of a peripheral fuel lean zone surrounding a fuel rich zone provides combustion in which the formation of $NO_x$ is reduced.

In addition, the channels 26 which converge in cross-section as the pulverized coal stream traverses from the inlet to the outlet ends of the channels, tend to increase the velocity of the stream. On the other hand, the diverging cross-section of the fuel lean channels 28 tend to reduce the speed of the fuel lean stream. As a result, the rotational force imparted to the fuel rich stream is greater than the rotational force imparted to the fuel lean stream.

As seen in FIG. 1, the burner is self-supported by a mounting member 70 which is positioned centrally within the outer housing 12 by a plurality of radial support struts 72. A pair of control rods 74 extend into the support member 70 and are attached to the burner tip 24. The control rods 74 enable an operator to change the position of the tip assembly with respect to the outer housing member 12. In particular, the tip 24 can be moved toward and away from the combustion zone and can be extended such that the outlet end of the tip 24 is exposed beyond the end of the outer housing member 12. Conversely, the tip 24 may be retracted so that it is totally enclosed by the outer housing member 12. Movements of the tip with respect to the combustion zone allow the flame and rate of combustion to be adjusted by the operator.

Figure 4:
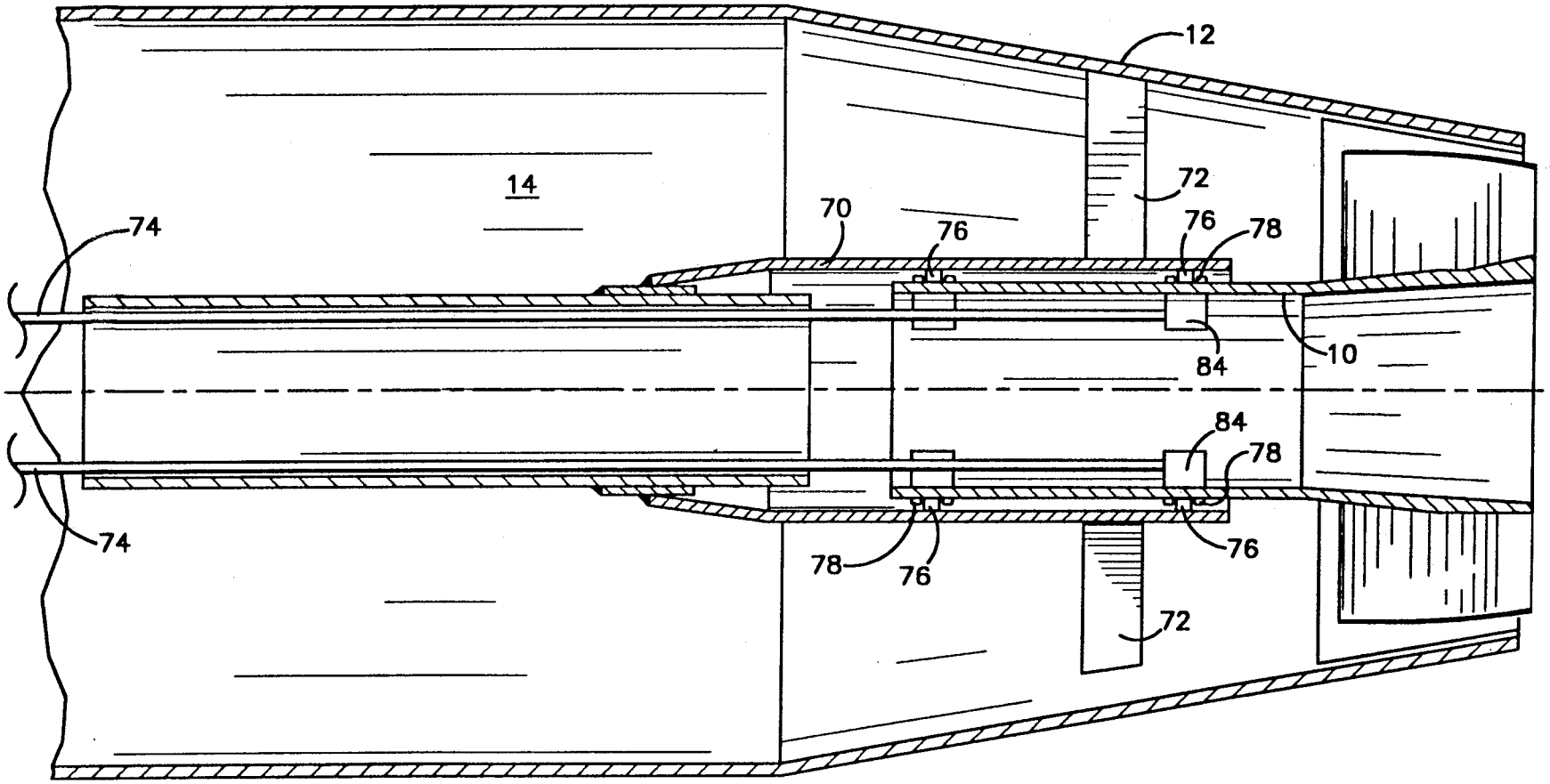
FIG. 4 is a sectional view, shown somewhat schematically, of the burner.

Referring also to FIG. 4, the core member 10 is mounted for sliding movement with respect to the mounting member 70. Slide support members 76 enable sliding movement between the two members. Packing 78 is used to provide a seal between the members 70 and 10 while still allowing sliding movement. The control rods 74 are attached to blocks 84 which, in turn, are welded to the inside of the core member 10. The control rods 74 extend to the outside of the burner region and are accessible by the boiler operator. Suitable manipulating devices such as turn buckles or threaded adjustment members (not shown) can be used to move the control rods 74 longitudinally to extend or retract the burner tip.

Referring to FIG. 2, the secondary blade 42 includes a relieved portion indicated generally by the reference character 80. In particular, the leading edge 42*b* of the blade 42 does not directly meet the inner housing member 10. A portion is removed indicated generally by the reference character 80. The extent of the relieved portion is determined by the application and is used in order to provide fine adjustments to the fuel lean, fuel rich stream patterns.

Although the invention has been described with a certain degree of particularity, it should be understood that those skilled in the art may make various changes to it without departing from the spirit or scope of the invention as hereinafter claimed.

In the claims:

1. A burner nozzle for combusting pulverized coal, comprising:

a) structure defining an annular passage extending from a source of pulverized coal carried by an air stream to an outlet, said outlet communicating with a combustion region for said pulverized coal;

b) said annular passage defined between an inner cylindrical member and an outer housing member, surrounding said inner cylindrical member;

c) means, near said outlet, for dividing said pulverized coal stream into fuel rich and fuel lean streams, including:

i) a plurality of first blade members, generally radially directed, and circumferentially spaced about said inner cylindrical member;

ii) second blade members spaced circumferentially about an inner cylindrical member and in an alternating relationship with said first blade members;

iii) said first blade members defining a first angle with respect to an imaginary plane extending through a center line of said inner cylindrical member;

iv) said second blade members defining a second angle with respect to an imaginary reference plane extending through said centerline that is greater than said first blade angle, such that a channel diverging in cross-section is defined between a first blade member and an adjacent second blade member and a channel converging in cross-section is defined between said second blade member and a next adjacent first blade member.

2. The burner of claim 1, wherein said first blade angle is substantially 15° and said second blade angle is substantially 25°.

3. The apparatus of claim 1, wherein said first blade member defines leading and trailing edges that are located in the same plane.

4. The burner of claim 1, wherein said first blade member includes a leading edge that is aligned with a radial vector extending through said centerline of said cylindrical member and a trailing edge that is disposed at an acute angle with respect to another radial vector extending through said centerline.

5. The burner of claim 4, wherein said acute angle comprises substantially 20°.

6. A burner nozzle for burning an annular stream of pulverized coal, comprising:

a) an annular passage defined between an outer housing member and an inner housing member extending between an inlet end and an outlet;

b) a coal stream dividing assembly located near said outlet end and disposed in said coal stream path to divide said pulverized said coal stream into fuel rich and fuel lean streams;

c) said assembly including members defining a plurality of channels having an expanding cross-section; and, d) a plurality of channels interposed between said expanding channels. having a converging cross-section such that an outlet side of said channel has a smaller cross-section than an inlet side of said channel.

7. The apparatus of claim 6, in which a center line of said converging channel is oriented at a predetermined angle with respect to a direction of flow of said pulverized coal stream of said assembly such that a spinning motion is imparted to said fuel rich streams as said streams are discharged from said outlet.

8. The apparatus of claim 6, wherein said fuel lean channels have a center line oriented a predetermined angle with respect to the direction of flow along said annular passage upstream of said outlet such that a spinning motion is imparted to said fuel lean streams as said streams are discharged at said outlet.

9. The apparatus of claim 6, wherein said fuel lean channels include a ramp-like surface near an outlet side of said channel which directs said stream in a direction diverging from a center line of said inner housing member.

10. The apparatus of claim 9, wherein said ramp-like surfaces are configured such that said fuel lean streams are directed toward a peripheral combustion region such that a fuel lean zone surrounds a fuel rich combustion zone whereby the formation of $NO_x$ is reduced.

11. The apparatus of claim 6, wherein said converging channel is defined in part by a first wall disposed at a first predetermined angle with respect to a center line of said burner and a second wall spaced from said first wall and positioned at a second angle greater than said first angle.

12. The apparatus of claim 11, wherein said first angle is substantially 15° and said second angle is substantially 25°.

13. The apparatus of claim 12, wherein said second wall is tilted at a predetermined angle with respect to a radial line passing through said center line of said burner.

14. The apparatus of claim 13, wherein said tilt angle is substantially 20°.

15. A burner tip for a burner used to combust a pulverized coal stream, comprising:

a) an inner support member;

b) fuel stream dividing structure including:

i) a plurality of first blade members, generally radially directed, and circumferentially spaced about said inner support member;

ii) second blade members spaced circumferentially about said inner support member and in an alternating relationship with said first blade members;

iii) said first blade members defining a first angle with respect to an imaginary plane extending through a center line of said inner support member;

iv) said second blade members defining a second angle with respect to an imaginary reference plane extending through said centerline that is greater than said first blade angle, such that a channel diverging in cross-section is defined between a first blade member and an adjacent second blade member and a channel converging in cross-section is defined between said second blade member and a next adjacent first blade member.

16. The burner tip of claim 15, wherein said first blade angle is substantially 15° and said second blade angle is substantially 25°.

17. The burner tip of claim 15, wherein said first blade member defines leading and trailing edges that are located in the same plane.

18. The burner tip of claim 15, wherein said first blade member includes a leading edge that is aligned with a radial vector extending through said centerline of said inner support member and a trailing edge that is disposed at an acute angle with respect to another radial vector extending through said centerline.

19. The burner of claim 18, wherein said acute angle comprises substantially 20°.

20. The burner tip of claim 15 wherein said inner support member is cylindrical.

21. A burner tip for a burner used to burn a stream of pulverized coal, comprising:

a) a cylindrical support member having an inlet end and an outlet end when said tip is placed in an operative position within said burner;

b) a coal stream dividing assembly located at or near said outlet end of said support member, said assembly operative to divide a pulverized coal stream into fuel rich and fuel lean streams;

c) said assembly including members defining a plurality of channels having an expanding cross-section; and, d) a plurality of channels interposed between said expanding channels, having a converging cross-section such that an outlet side of said channel has a smaller cross-section than an inlet side of said channel.

22. The burner tip of claim 21, wherein at least some of said fuel lean channels are defined at least in part by members having ramp-like surfaces near an outlet side of said channels which directs said stream in a direction diverging from a center line of said support member.

23. The burner tip of claim 21, wherein said converging channel is defined in part by a first wall disposed at a first predetermined angle with respect to a center line of said support member and a second wall spaced from said first wall and positioned at a second angle greater than said first angle.

24. The burner tip of claim 23, wherein said first angle is substantially 15° and said second angle is substantially 25°.

25. The burner tip of claim 23, wherein said second wall is tilted at a predetermined angle with respect to a radial line passing through said center line of said support member.

26. The burner tip of claim 25, wherein said tilt angle is substantially 20°.

* * * * *